US006444902B1

(12) United States Patent
Tsao et al.

(10) Patent No.: US 6,444,902 B1
(45) Date of Patent: Sep. 3, 2002

(54) ELECTRICAL CABLE

(75) Inventors: Pei Tsao, Cypress; Frank Quach, Irvine, both of CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/835,925

(22) Filed: Apr. 10, 2001

(51) Int. Cl.[7] ..... H01B 11/02
(52) U.S. Cl. ..... 174/36; 174/113 R; 174/117 F
(58) Field of Search ..... 174/36, 117 F, 174/107, 102 R, 113 R, 116, 117 FF

(56) References Cited

U.S. PATENT DOCUMENTS 4,234,759 A * 11/1980 Harlow ..... 174/103
5,208,426 A * 5/1993 Kennedy et al. ..... 174/102 SC
5,416,268 A * 5/1995 Ellis ..... 174/102 R
5,872,334 A * 2/1999 Trazyik ..... 174/107

* cited by examiner

*Primary Examiner*—Chau N. Nguyen
(74) *Attorney, Agent, or Firm*—Wei Te Chung

(57) ABSTRACT

An electrical cable (1) for signal transmission includes a pair of signal transmission groups (12), a single non-insulated first drain wire (14) sandwiched between adjacent inner sides (154) of the signal transmission groups and a pair of non-insulated second drain wires (16) disposed at opposite outer sides (156) of the transmission groups. Each signal transmission group has a pair of insulated signal conductors (13) and a layer (15) of shielding surrounding the insulated signal conductors. Both the first and second drain wires are electrically contacted with outside surfaces (152) of the layers of shielding for providing grounding function. All the signal conductors and the first and second drain wires are arranged side by side and their axes fall on a common plane (10). An optional jacket (17) is wrapped on the signal transmission groups and the first and second drain wires.

6 Claims, 2 Drawing Sheets

ELECTRICAL CABLE

BACKGROUND OF THE INVENTION

1. Field of The Invention

The present invention relates to an electrical cable, and particularly to an electrical cable which provides an improved shielding means.

2. Description of Prior Art

With the development of computer technology, a new product, named as a serial ATA electrical connector, is developed for use as an interface of fast-talking drives, which will effectively double the bandwidth, or capacity for data, between disk drives—-ranging from hard drives to CD-rewritable drives—-and other PC components. Referring to FIG. 3, such a serial ATA cable 3 for signal transmission comprises twin axial or parallel pair cable subassemblies 32. Each cable subassembly 32 includes a pair of insulated signal conductors 34 and a pair of non-insulated grounding drain wires 36 besides the two signal conductors 34, all of which are arranged side by side as shown, and all of the signal conductors 34 and drain wires 36 fall on a common plane 30. A layer of conductive shielding 38 is wrapped around the pair of signal conductors 34 and drain wires 36 so that it is in electrical contact with the drain wires 36. An optional jacket 39 is covered over the pair of shieldings 38. The shielding 38 prevents emissions from the cable 3 as well as provides isolation from nearby or stray signals, and the planar structure of the cable provides advantages in routing and other cable management tasks for certain applications. However, the pair of cable subassemblies 32 are isolated from each other by a portion of the jacket 39, and the number of the drain wires 36 adapted for grounding are comparatively too many, thereby resulting in an increase in the whole width of the electrical cable 3 and complicating the manufacturing process of the cable 3 as well.

Hence, an improved shielded cable is required to overcome the disadvantages of the prior art.

BRIEF SUMMARY OF THE INVENTION

A main object of the present invention is to provide an electrical cable having relative reduced whole width and low cost while providing an effective grounding function.

An electrical cable for signal transmission comprises a pair of signal transmission groups, a single non-insulated first drain wire sandwiched between adjacent inner sides of the signal transmission groups and a pair of non-insulated second drain wires disposed at opposite outer sides of the transmission groups. Each signal transmission group has a pair of insulated signal conductors and a layer (15) of shielding, made of aluminum foil or the like, surrounding on the insulated signal conductors. Both the first and second drain wires are electrical contacted with associated outside surfaces of the layers of shielding for providing a grounding circuit. All of the signal conductors and the first and second drain wires are arranged side by side and their axes fall on a common plane. An optional jacket is wrapped on the signal transmission groups and the first and second non-insulated drain wires.

Other objects, advantages and novel features of the invention will more apparent from the following detailed description of the present embodiment when taken in conjunction with the accompanying drawings.

DETAILED DESCRIPTION OF THE INVENTION

Figure 1:
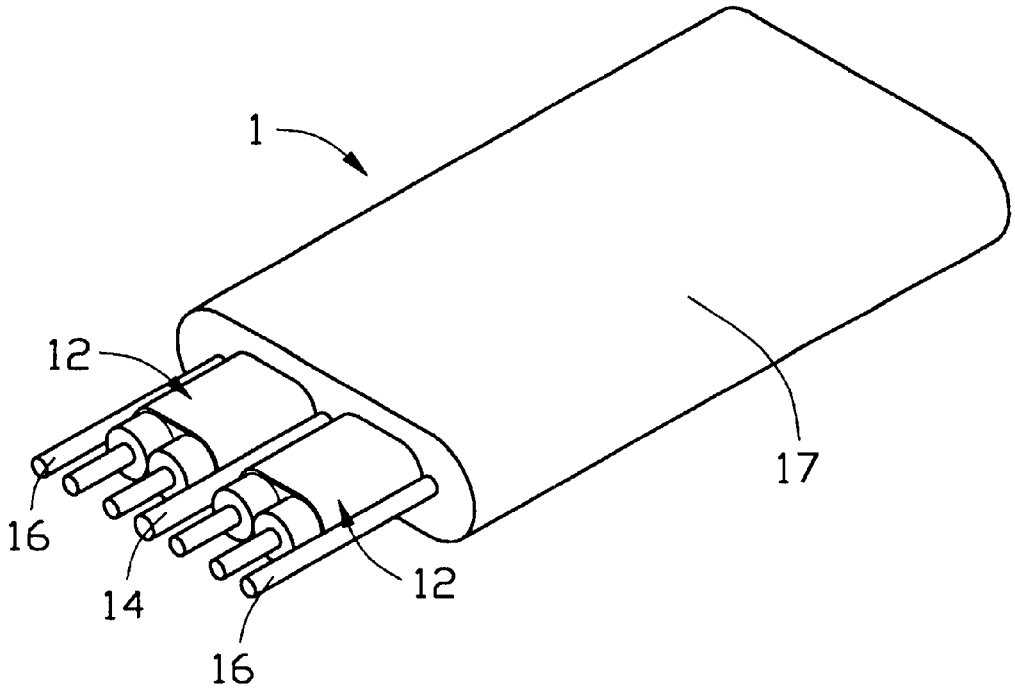
FIG. 1 is a perspective view of an electrical cable in accordance with the present invention.
Figure 2:
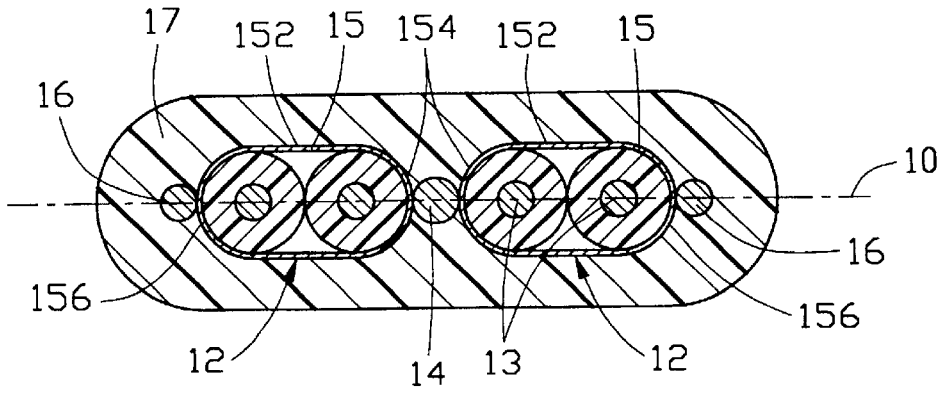
FIG. 2 is a cross-sectional view of the shielded cable of FIG. 1.
Figure 3:
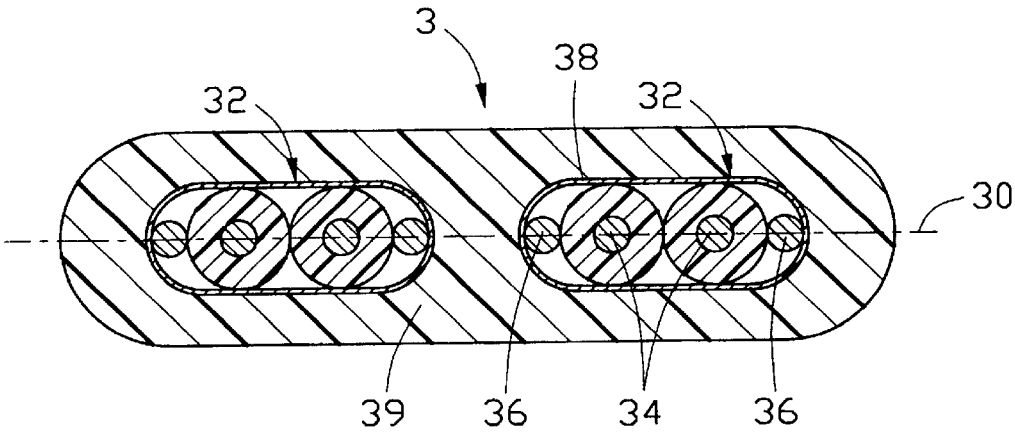
FIG. 3 (PRIOR ART)
FIG. 3 is a cross-sectional view of a conventional shielded cable.

Referring to FIGS. 1 and 2, an electrical cable 1 used in a serial ATA connector for signal transmission is shown. The shielded cable 1 includes a pair of signal transmission groups 12, one first and two second drain wires 14, 16 parallelly arranged among the signal transmission groups 12 and an outer jacket 17 surrounding both the signal transmission groups 12 and the drain wires 14, 16.

Each signal transmission group 12 includes a pair of insulated signal conductors 13 and a layer 15 of shielding, made up of aluminum foil or the like, wrapping on the insulated signal conductors 13. The first non-insulated drain wire 14 is sandwiched between two adjacent inner sides 154 of the signal transmission groups 12, and the second non-insulated drain wires 16 are disposed on opposite outer sides 156 of the signal transmission groups 12. Both the fist and second drain wires 14, 16 are in electrical contact with outside surfaces 152 of the two layers 15 of shielding for attaining a grounding circuit. All of the signal conductors 13, first and second drain wires 14, 16 are parallelly arranged side by side and their axes fall on a common plane, designated as 10.

Compared with the prior art, one drain wire is eliminated in the shielded cable 1 of the present invention, but achieving the same grounding feature. Accordingly, the shielded cable 1 is improved in a reduced whole width thereof and a low manufacturing cost thereof, with respect to the prior art.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical cable comprising a pair of signal transmission groups each group having a pair of insulated signal conductors and a layer of shielding wrapped on the insulated signal conductors, a single non-insulated first drain wire sandwiched between adjacent inner sides of the signal transmission groups, and a pair of non-insulated second drain wires disposed at opposite outer sides of the transmission groups, both the first and second drain wires being conductively contacted with outside surfaces of the pair of layers of shielding, wherein the first drain wire has a cross-section larger than that of the second drain wire.

2. The electrical cable as claimed in claim 1, wherein the layer of shielding is made up of aluminum foil.

3. The electrical cable as claimed in claim 1, wherein all of the signal conductors and the first and second drain wires are arranged side by side and their axes fall on a common plane.

4. The electrical cable as claimed in claim 1, wherein an outer jacket is wrapped on all of the signal transmission groups and the first and second drain wires.

5. An electrical cable comprising at least side by side one pair of signal transmission groups each group having a pair of insulated signal conductors surrounded by a layer of shielding, one single non-insulated drain wire sandwiched between said pair of signal transmission groups in mechanical and electrical contact with the corresponding layers of shielding, and at least one additional non-insulated drain wire disposed at one lateral end of one of said pair of signal transmission groups in contact with the corresponding layer of shielding opposite to said single drain wire, wherein said single drain wire has a cross-section larger than that of the additional drain wire.

6. The cable as claimed in claim 5, wherein said pair of signal transmission groups, said single drain wire and said additional drain wire are aligned along a lateral direction of said cable.

* * * * *